US005867943A

United States Patent [19]

Thomas

[11] Patent Number: 5,867,943

[45] Date of Patent: Feb. 9, 1999

[54] RAIN CUTTER ASSEMBLY

[75] Inventor: Lloyd Gene Thomas, Perrysburg, Ohio

[73] Assignee: Great Lakes Standard Manufacturing, Inc., Toledo, Ohio

[21] Appl. No.: 959,701

[22] Filed: Oct. 29, 1997

[51] Int. Cl.[6] ..... E04D 13/00

[52] U.S. Cl. ..... 52/11; 52/16; 285/139.1

[58] Field of Search ..... 52/11, 12, 15, 52/16; 285/139.1, 194

[56] References Cited

U.S. PATENT DOCUMENTS

| | | |
|---|---|---|
| 617,658 | 1/1899 | Schwone et al. . |
| 2,274,078 | 2/1942 | Marzolf . |
| 2,808,825 | 10/1957 | Solomon . |
| 3,703,194 | 11/1972 | Giordano . |
| 4,328,694 | 5/1982 | Beaumont . |
| 4,619,554 | 10/1986 | Walker et al. . |
| 5,071,174 | 12/1991 | Griffin et al. . |
| 5,302,283 | 4/1994 | Meuche . |
| 5,634,299 | 6/1997 | Gaston . |

FOREIGN PATENT DOCUMENTS

| | | | |
|---|---|---|---|
| 1187528 | 5/1985 | Canada | 52/16 |
| 2 249 338 | 5/1992 | United Kingdom . | |

*Primary Examiner*—Lanna Mai

*Attorney, Agent, or Firm*—Emch, Schaffer, Schaub & Porcello, Co., L.P.A.

[57] ABSTRACT

The present invention relates to a gutter assembly for use with a longitudinally extending trough or gutter having an opening extending therethrough. The gutter assembly includes an outlet having a flange adjacent its upper end. The outlet extends through the opening with the flange adjacent the trough. A locking ring surrounds the outlet and is positioned adjacent the trough in opposed relationship to the outlet flange.

7 Claims, 7 Drawing Sheets

FIG. 7
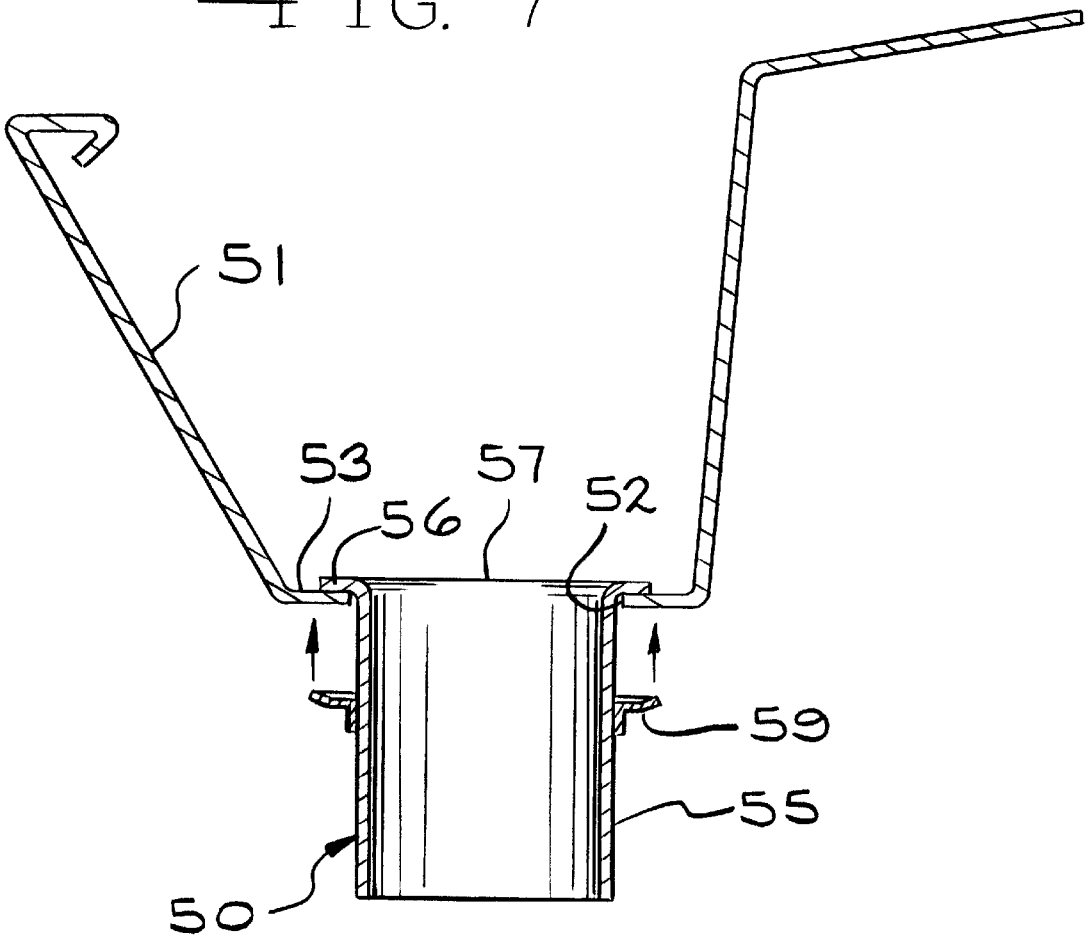
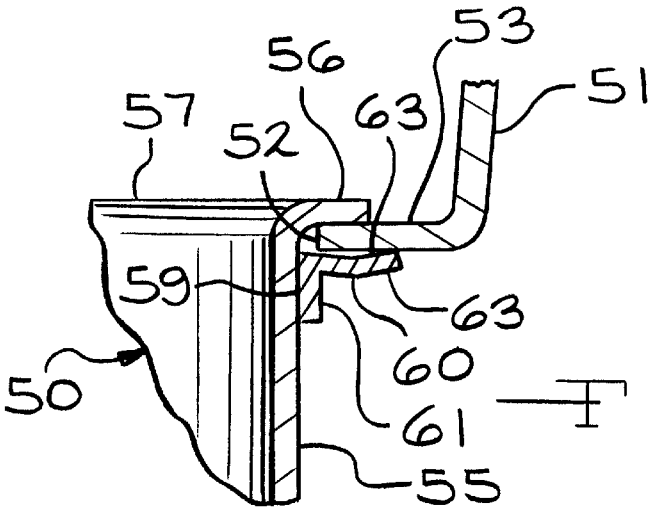
FIG. 8

RAIN CUTTER ASSEMBLY

BACKGROUND OF THE INVENTION

The present invention is directed to a rain gutter assembly. Rain troughs and rain gutters are well known in the art. Normally, the longitudinally extending trough or gutter includes an opening in the bottom through which water or another liquid runs. The opening is often connected to a downspout which carries the water downwardly to the ground or to a connecting sewer system.

In other prior art devices, an outlet extends from the opening. The outlet can either be a part of the overall downspout or in the alternative, is a short connector piece which then connects to the downspout.

U.S. Pat. No. 617,658 which was issued to Schwone and Lamper shows a downspout having an angular flange at its upper end. The downspout extends through the opening and the flange bears against the bottom of the eaves trough.

Giordano, U.S. Pat. No. 3,703,194 discloses a resilient tube or outlet which includes a flange which rests on the surface of a gutter. The resilient tube is disclosed as being either circular or rectangular.

Beaumont, U.S. Pat. No. 4,328,694 and Walker et al., U.S. Pat. No. 4,619,559 disclose outlet tubes which have flanges and are rectangular in cross-section.

The present invention is directed to an improved rain gutter assembly which may be securely connected to a gutter or trough.

SUMMARY OF THE INVENTION

The present invention is directed to a rain gutter assembly for use with a longitudinally extending trough which defines an opening therethrough. The gutter assembly includes an outlet having a flange adjacent its upper end. The outlet is positionable through the trough opening. A locking ring surrounds the outlet and is tightly positioned adjacent the trough in opposed relationship to the flange. The locking ring securely locks the outlet to the trough.

BRIEF DESCRIPTION OF THE DRAWINGS

FIG. 7 is a cross-sectional view showing still another embodiment of a gutter assembly, according to the present invention with the locking ring being moved upwardly into position against the trough; and FIG. 8 is an enlarged fragmentary cross-sectional view showing the FIG. 7 embodiment after installation is completed.

DETAILED DESCRIPTION OF THE PREFERRED EMBODIMENT

Figure 1:
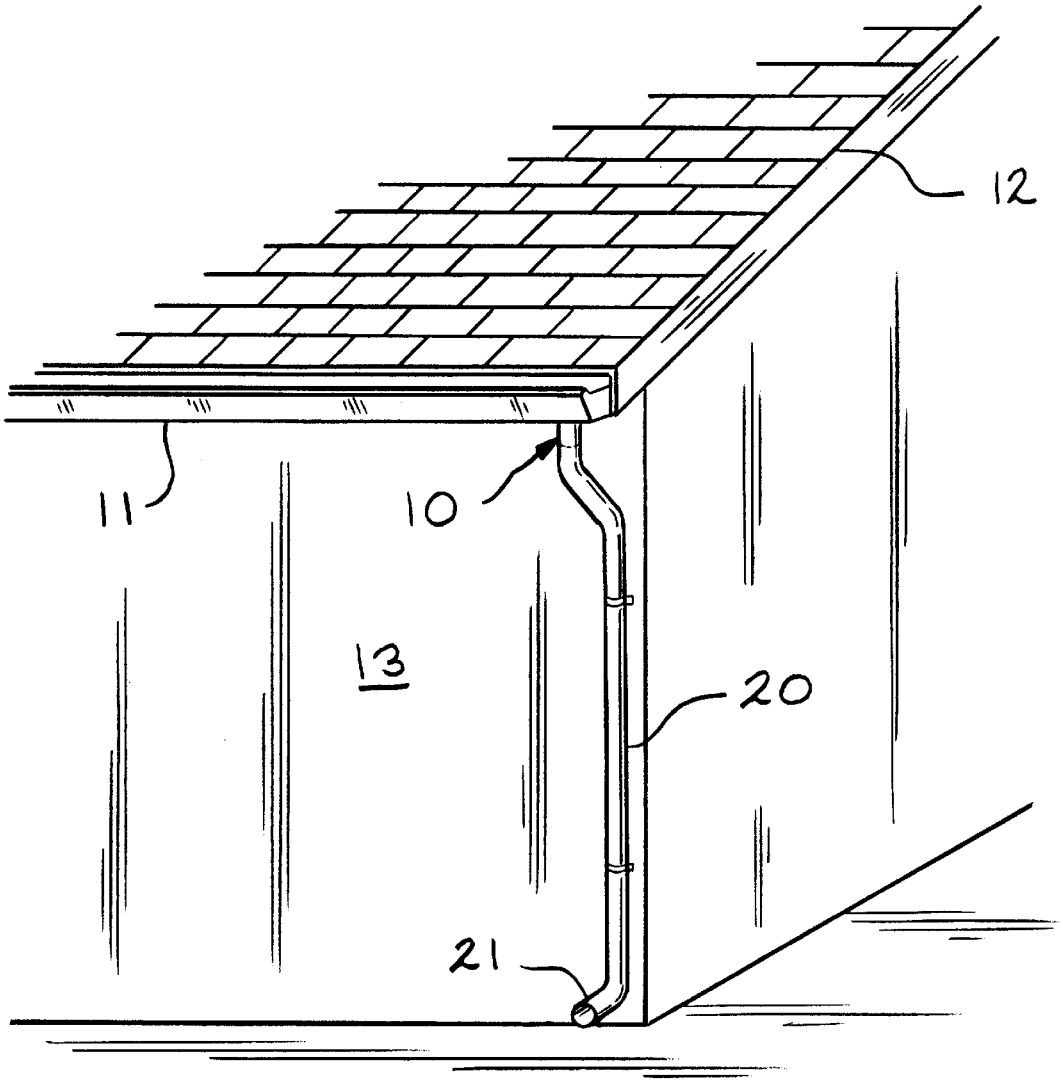
FIG. 1 is a perspective view of a drainage system for a building including a gutter assembly, according to the present invention.
Figure 2:
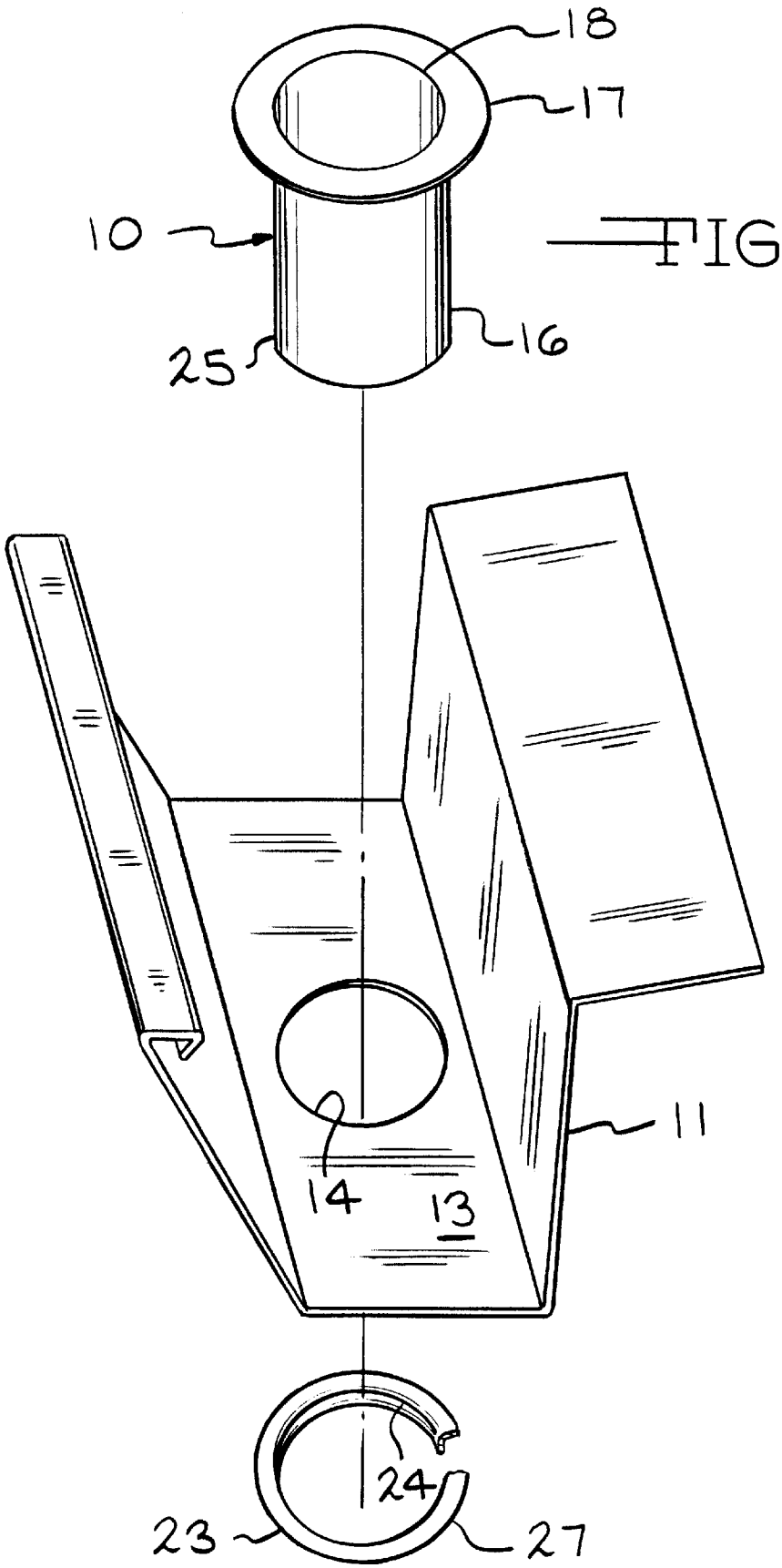
FIG. 2 is an exploded view showing the gutter assembly, according to the present invention.
Figure 3:
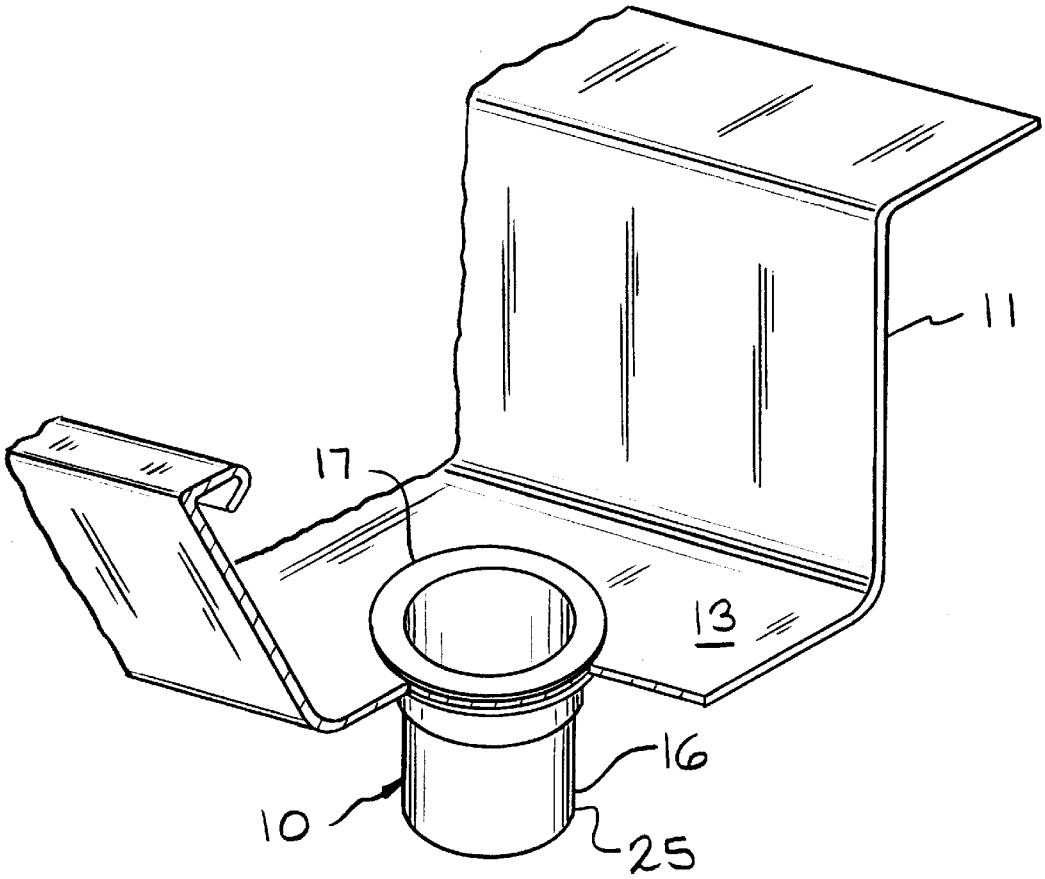
FIG. 3 is a fragmentary perspective view, partially in cross-section, showing the gutter assembly, according the present invention, installed in a trough.

A gutter assembly, according to the present invention, is indicated in FIGS. 1–3 by the reference number 10. Referring to FIG. 1, a longitudinally extending eave or trough 11 is often positioned at the lower end of a roof 12 of a building 13. As shown in FIG. 2, the trough 11 includes a bottom 13 which defines an opening 14 extending therethrough. The gutter assembly 10 includes an outlet tube or outlet 16 having a circular cross-section and a flange 17 adjacent its upper end 18.

Referring to FIG. 1, a downspout 20, having a discharge end 21, is mounted below the outlet 16.

When the outlet 16 is positioned through the trough opening 14, the flange 17 is positioned tightly adjacent the bottom 13 of the trough 11. If desired, a sealant may be applied between the flange 17 and the bottom 13 of the trough 11.

An important feature of the present invention is a locking ring 23 which surrounds the outlet 16 and is positioned tightly adjacent the trough 11 in opposed relationship to the flange 17. The locking ring 23 includes an inner diameter 24 which is complementary with the outer diameter 25 of the outlet 16. The locking ring 23 is mounted tightly adjacent the trough 11.

Preferably, the trough 11, the outlet 16 and the locking ring 23 are constructed of metal, however, they may be constructed of other materials such as plastic materials. Preferred metals are steel and aluminum.

Referring to FIG. 2, the locking ring 23 has an upper portion 27 and a lower neck portion 28 extending downwardly from the upper portion 27. The upper portion 27 may be flat, but preferably flares upwardly. The flare is compressed against the trough 11 during installation. The lower neck portion 28 defines the inner diameter 24 which is complementary with the outer diameter 25 of the outlet 16. The lower neck portion 28 has a friction fit with the outlet 16 when positioned adjacent the trough 11.

Figure 4:
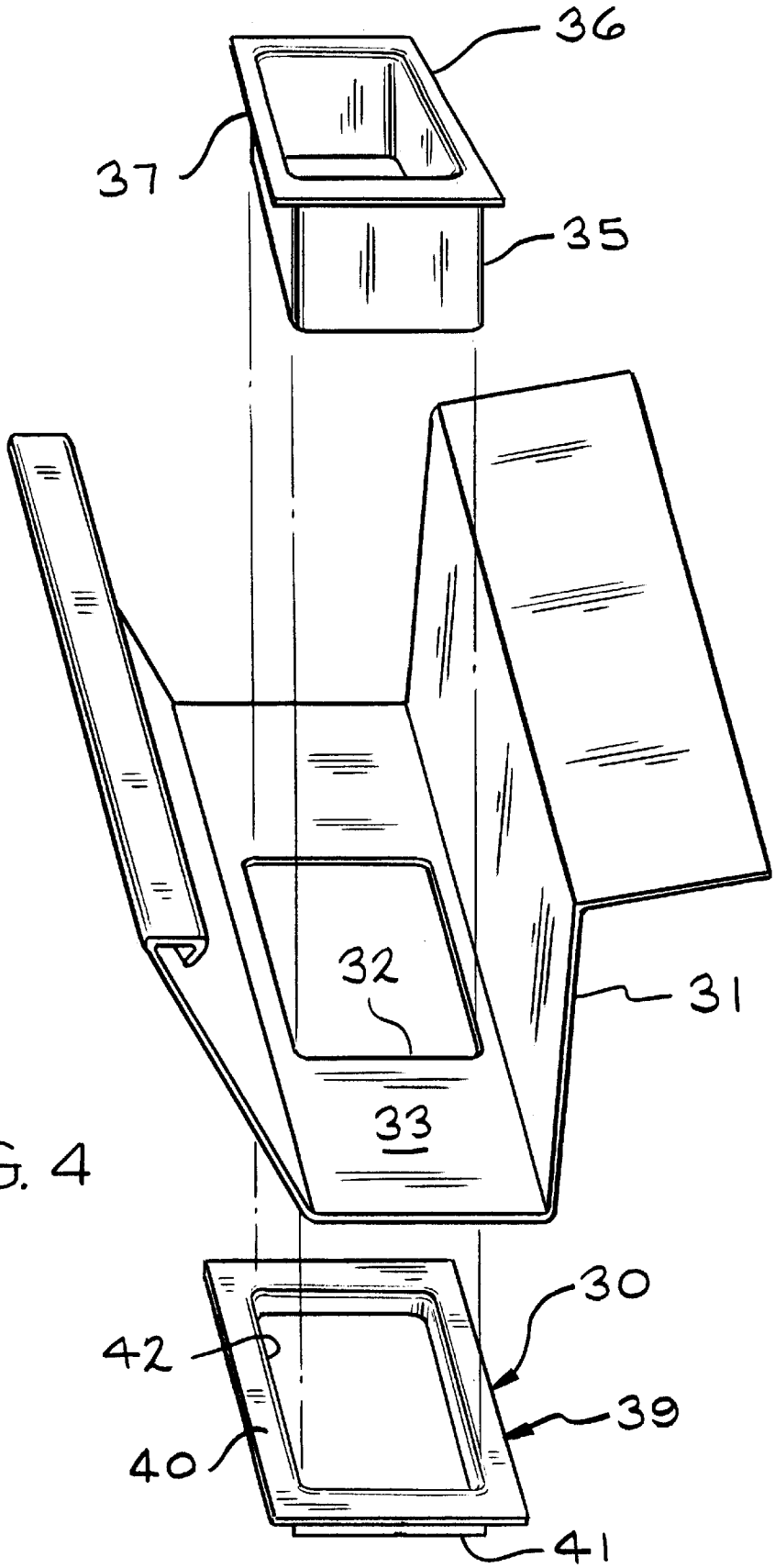
FIG. 4 is an exploded view, similar to FIG. 2 showing another embodiment of a gutter assembly according to the present invention.
Figure 5:
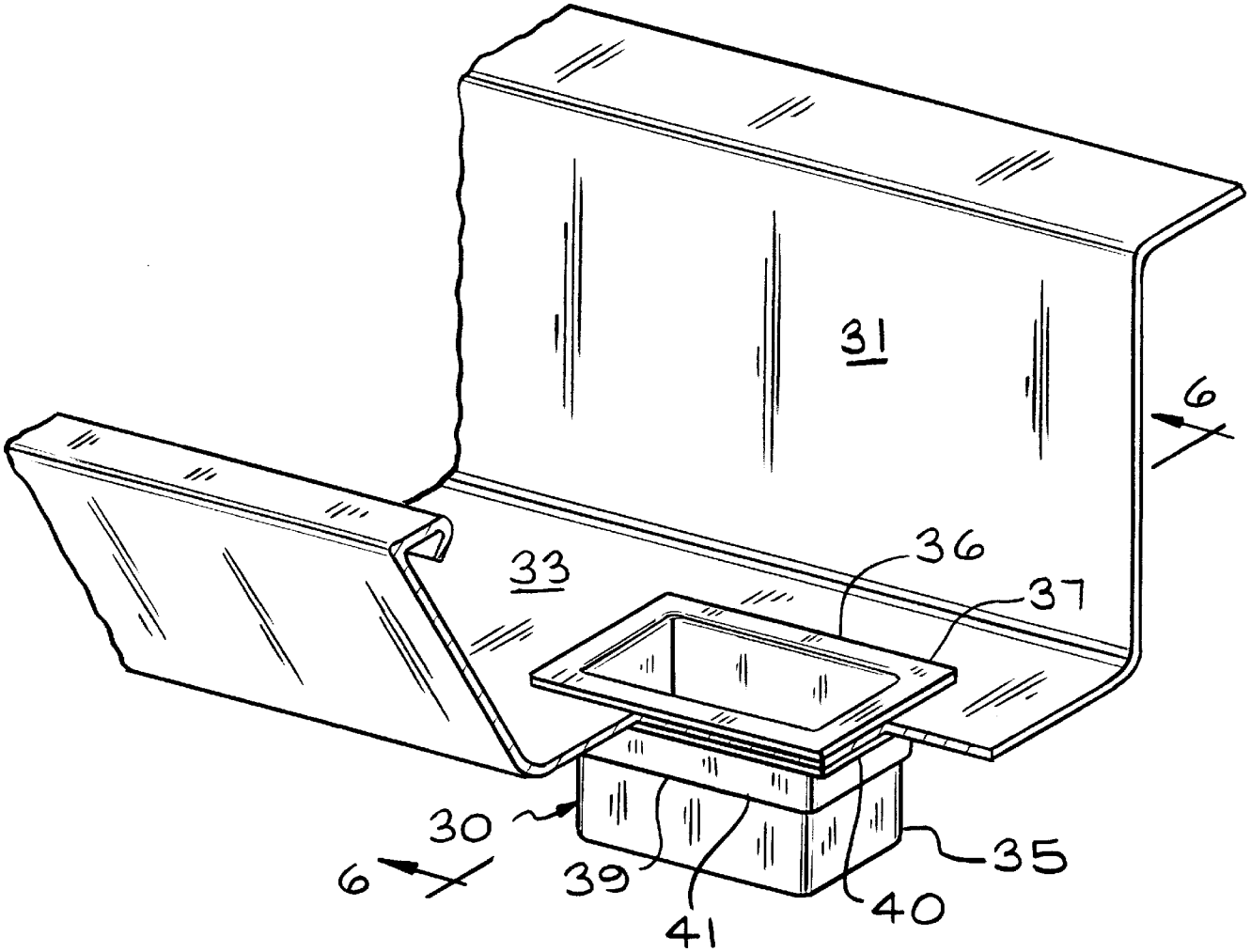
FIG. 5 is a fragmentary perspective view, partially in cross-section showing the assembled gutter assembly of the FIG. 4 embodiment.
Figure 6:
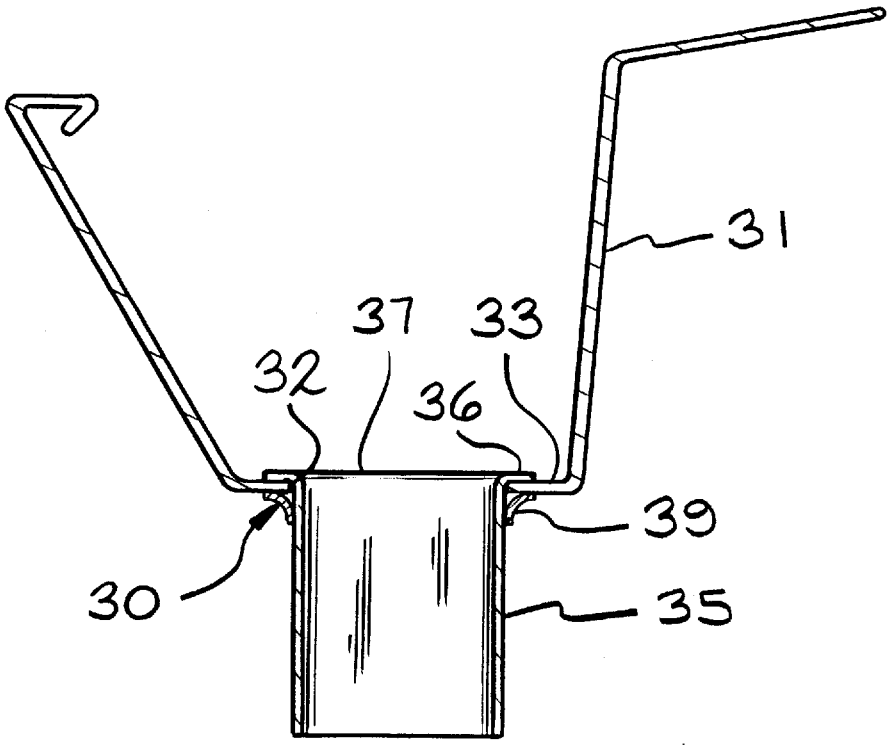
FIG. 6 is a cross-sectional view taken along the lines 6—6 of FIG. 5.

Another embodiment of a gutter assembly, according to the present invention, is indicated by the reference number 30 in FIGS. 4–6. A longitudinally extending trough 31 defines a rectangular opening 32 through its bottom 33.

The gutter assembly 30 includes a rectangularly shaped outlet 35 having a rectangular flange 36 adjacent its upper end 37. The gutter assembly 30 also includes a rectangularly shaped locking ring 39 having an upper portion 40 and a lower neck portion 41 which extends downwardly from the upper portion 40. The neck portion 41 defines a generally rectangular opening 42 for receiving the outlet 35. The lower neck portion 41 has a periphery complementary with the outer periphery of the outlet 35, thereby forming a friction fit between the two components, when in the assembled position shown in FIGS. 5 and 6.

The gutter assembly 30 is preferably constructed of a metal, such as steel or aluminum, but again may be constructed of other materials, including plastic materials.

Still another embodiment of a gutter assembly, according to the present invention is indicated by the reference number 50 in FIGS. 7 and 8. A longitudinally extending trough 51 defines a circular opening 52 through its bottom 53. An outlet 55, having a circular configuration, includes a flange 56 adjacent its upper end 57. The gutter assembly 50 also includes a circular locking ring 59 having an upper portion 60 and a lower neck portion 61. The upper portion 60 of the locking ring 59 has a sharp upward flare or bevel 63. The upper portion 60 of the locking ring 59 extends upwardly and outwardly from the lower neck portion 61. When the locking ring 59 is positioned on the outlet 55, as shown in FIG. 7, the locking 59 has an inner periphery which is complementary with the outer periphery of the outlet 55. A friction fit is provided between the outlet 55 and the locking ring 59. When the upper portion 60 of the locking ring 59 reaches its final position adjacent the trough 51, the bevel 63 is compressed tightly against the trough 51 to form a tight connection. Again, if desired, a sealant may be positioned between the flange 56 of the outlet 55 and the bottom 53 of the trough 51 to ensure a water tight connection.

The gutter assembly 50 is preferably constructed of metal, such as aluminum or steel, but again may be constructed of a plastic material.

Many changes may be made to the above-described embodiments without departing from the scope of the invention or from the following claims.

I claim:

1. A gutter assembly comprising a longitudinally extending trough defining an opening therethrough, said gutter assembly including an outlet having a flange adjacent its upper end, said outlet being positioned through said trough opening and a locking ring surrounding said outlet and positioned adjacent said trough in opposed relationship to said flange, said locking ring having an upper portion extending generally perpendicularly from a neck portion, said neck portion extending downwardly from said upper portion, said lower neck portion of said locking ring having an inner dimension complementary with the outer dimension of said outlet, said locking ring having a friction fit with said outlet when positioned adjacent said trough.

2. A gutter assembly, according to claim 1, wherein said outlet and said locking ring are constructed of metal.

3. A gutter assembly, according to claim 1, wherein said upper portion of said locking ring has a flared portion forming its outer edge, said lower neck portion defining an opening for closely and frictionally receiving said outlet.

4. A gutter assembly, according to claim 3, wherein said outlet has a circular cross-section and wherein said lower neck portion has an inner diameter complementary with the outer diameter of said outlet, said lower neck portion having a friction fit with said outlet when positioned adjacent said trough.

5. A gutter assembly according to claim 3, wherein said upper portion of said locking ring extends upwardly and outwardly from said lower neck portion.

6. A gutter assembly, according to claim 1, wherein said locking ring and said outlet each have a circular cross-section.

7. A gutter assembly, according to claim 1, wherein said locking ring and said outlet each have a rectangular cross-section.

* * * * *

UNITED STATES PATENT AND TRADEMARK OFFICE

CERTIFICATE OF CORRECTION

PATENT NO. : 5,867,943

DATED : February 9,1999

INVENTOR(S) : Lloyd G. Thomas

It is certified that error appears in the above-identified patent and that said Letters Patent is hereby corrected as shown below:

On the title page, item [54] and column 1, should read:

Title should be "RAIN GUTTER ASSEMBLY".

Signed and Sealed this

Twentieth Day of July, 1999

*Attest:*

*Attesting Officer*

Q. TODD DICKINSON

*Acting Commissioner of Patents and Trademarks*